United States Patent [19]

Edwards et al.

[11] 4,194,456

[45] Mar. 25, 1980

[54] BLIND STITCH MECHANISM

[75] Inventors: William J. Edwards, Cranbury; Herbert T. Hurler, Elizabeth, both of N.J.

[73] Assignee: The Singer Company, New York, N.Y.

[21] Appl. No.: 20,785

[22] Filed: Mar. 15, 1979

[51] Int. Cl.[2] ..... D05B 1/24

[52] U.S. Cl. ..... 112/176; 112/168; 112/184; 112/323

[58] Field of Search ..... 112/424, 425, 197, 198, 112/199, 200, 201, 202, 184, 168, 176, 323, 187

[56] References Cited

U.S. PATENT DOCUMENTS

| | | | |
|---|---|---|---|
| 2,390,126 | 12/1945 | Schifter | 112/198 |
| 2,636,461 | 4/1953 | Mikolas | 112/98 |
| 2,989,017 | 6/1961 | Taketomi | 112/187 |
| 3,908,569 | 9/1975 | Ketterer | 112/197 |
| 3,986,469 | 10/1976 | Ketterer | 112/424 |

FOREIGN PATENT DOCUMENTS 41-21544 12/1966 Japan .

*Primary Examiner*—Thomas F. Callaghan
*Assistant Examiner*—Andrew M. Falik
*Attorney, Agent, or Firm*—Robert E. Smith; Edward L. Bell; Michael H. Wallach

[57] ABSTRACT

An improved mechanism for producing blind stitches with a household sewing machine, including a removable throat plate having a thread deflecting member reciprocatorily driven into engagement with a loop of thread carried by the loop taker to insure engagement of the loop of thread by a hook needle. The thread deflecting member is driven in timed relation to the rising and falling motion of the feed dog by a cam which is fastened to the feed drive shaft.

6 Claims, 13 Drawing Figures

BLIND STITCH MECHANISM

BACKGROUND OF THE INVENTION

1. Field of the Invention:

This invention relates to sewing machines in general and more particularly to lock stitch sewing machines in which it is desirable to incorporate the capability of selectively producing blind stitches.

2. Description of the Prior Art:

The formation of blind stitches is particularly useful for home sewing applications when it is desired to secure a hem fold in place in such fashion that the noticeability of the stitches on the face of the garment is minimized. Commercial sewing machines incorporating the capability of producing blind stitches have long been known in the prior art. These machines are not practical for household use however, since they are specialized to produce but one type of stitch. The U.S. Pat. No. 3,986,469 to Ketterer, which issued on Oct. 19, 1976, the teachings of which are incorporated herein by reference, discloses a method for producing a blind stitch which is suitable for use with a household sewing machine. A thread manipulating mechanism for carrying out the teachings of the Ketterer U.S. Pat. No. 3,986,469, which is suitable for use on a household lock stitch sewing machine, is disclosed in U.S. Pat. No. 3,908,569 which also issued to Ketterer on Sept. 30, 1975, the teachings of which are also incorporated herein by reference.

While the mechanism disclosed in the U.S. Pat. No. 3,908,569 to Ketterer Pat. is capable of producing blind stitches, the mechanism incorporated therein for precluding the skipping of stitches is driven by the horizontal motion of the feed dog toward and away from the needle accommodating slot and is dependent on the horizontal feed dog motion which may be adjusted by the sewing machine operator by manipulation of the stitch length regulator. Accurate production of blind stitches using the Ketterer U.S. Pat. No. 3,908,569 mechanism required that the thread deflecting member engage the loop of thread seized by the beak of the loop taker and sweep it in an appreciable arc around the body of the hook needle to produce a certainty that the hook needle would engage the loop of thread. Certain ranges of small feed dog motion which may be acceptable for movement of fabric by the feed dog have been found to produce excursions of the blind stitch thread manipulating mechanism which were inadequate to carry the thread into a reliable position for seizure by the hook needle, with the attendant possibility of producing imperfect stitches. Since the production of a blind stitch involves drawing a loop of thread through a previously formed loop in much the same manner as the production of a chain stitch, the production of an imperfect blind stitch will cause the stitch to unravel.

SUMMARY OF THE INVENTION

It is an object of this invention to provide an improved mechanism for producing blind stitches which operates independent of the stroke of fabric feed imparted to the garment by the feed dog.

It is another object of this invention to provide a blind stitch mechanism for a household sewing machine which will not interfere with the ability of the machine to produce lock stitches.

Still another object is to produce a mechanism which aids in the formation of blind stitches without interferring with the removal of the throat plate.

It is also an object of this invention to provide a blind stitch mechanism which may be easily connected and disconnected to the driving mechanism of the sewing machine with a minimum of operator effort.

The above objects and other advantages are achieved using a needle with a thread engaging hook mounted alongside a conventional thread carrying needle. The throat plate has pivotally fastened to its underside a thread deflecting member which carries a thread engaging finger at one extremity thereof. The thread deflecting member is driven in an arcuate path to carry a loop of thread from the conventional needle to the hook needle. The thread deflecting member is driven in timed synchronization to the rotation of the feed drive shaft, but operates independent of the feed stroke imparted to the material by the feed dog.

BRIEF DESCRIPTION OF THE DRAWINGS

The above and other objects of this invention will become evident from a full and complete understanding of the preferred embodiment which is hereinafter set forth in such detail as to enable those skilled in the art to readily understand the function, operation, construction, and advantages of it when read in conjunction with the accompanying drawings in which.

DESCRIPTION OF THE PREFERRED EMBODIMENT

Figures 1, 8:
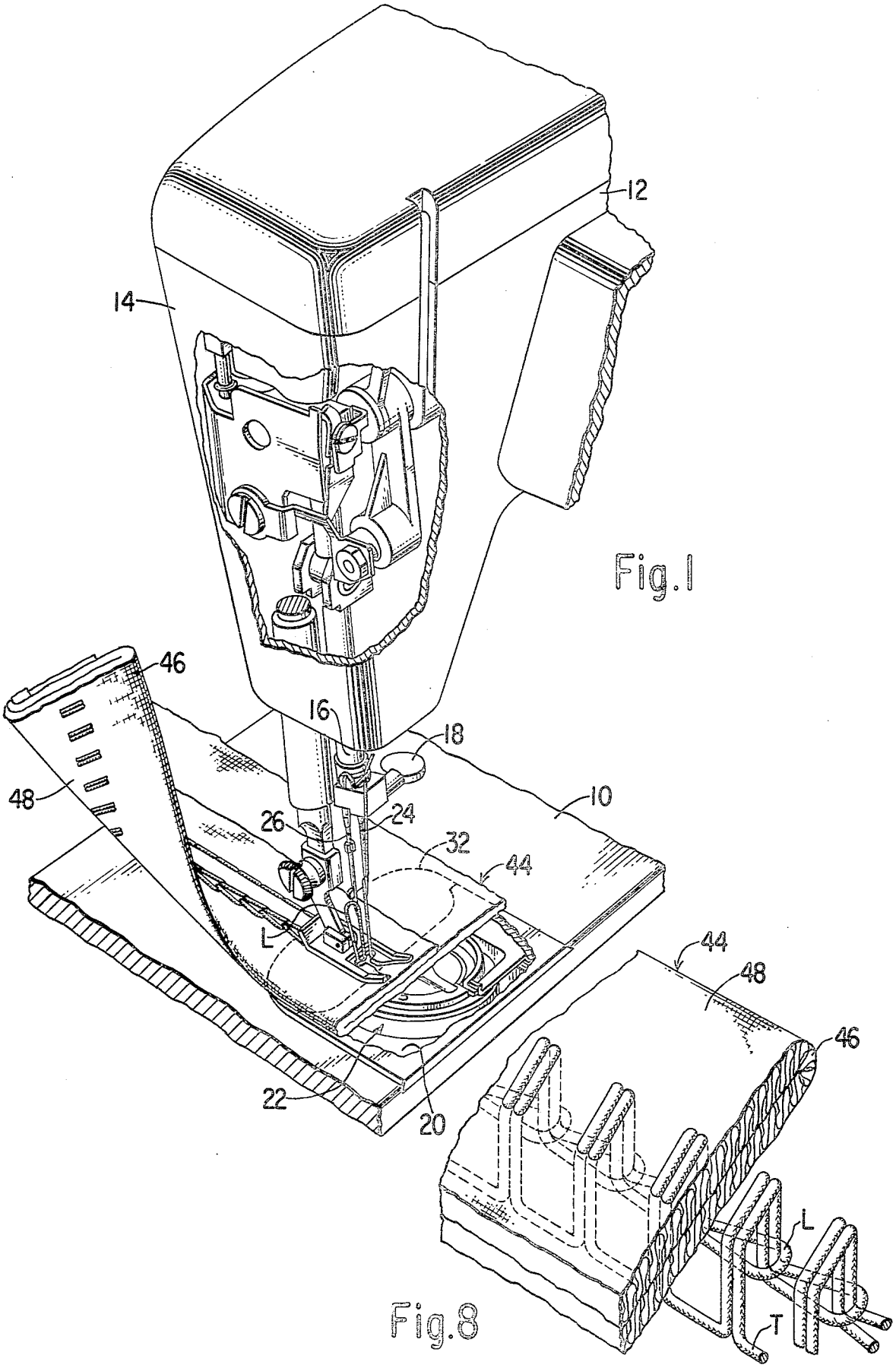
FIG. 1 is a perspective view of a portion of a sewing machine having a blind stitch mechanism constructed in accordance with the teachings of this invention applied thereto.
FIG. 8 is a perspective view of the thread concatenation including a fragment of the work fabric as viewed from the bottom during the formation of a seam using the mechanism disclosed in this invention.

Referring to the drawings, FIG. 1 shows a fragment of a sewing machine having a bed 10 and an arm 12 overhanging the bed 10. The arm 12 terminates in a sewing head 14 which contains a needle bar 16 which may be reciprocatorily driven toward and away from a stitch forming area formed on the bed 10. The needle bar 16 contains a clamp means, as for example the screw 18, which may be used to fasten a needle thereto. The bed 10 has a cavity 20 formed therein in which resides a loop taker 22 preferably having a vertical axis and a loop seizing beak 23 rotatable carried on the loop taker in a substantially horizontal plane about the axis of the loop taker.

As is best shown in FIG. 1, the needle bar 16 carries a pair of needles 24 and 26 arranged in side-by-side relation laterally of the line of work feed of the sewing machine as determined by the feeding path of a feed dog 28 of a conventional four motion work feeding mechanism having at least one component of motion adjustable by operator influenced motion varying means, which feed dog 28 works upwardly through at least one slot 30 formed in a throat plate 32 carried on the sewing machine bed 10. The needles 24 and 26 reciprocatorily pass endwise through an elongated slot 34 formed in the throat plate 32.

Figure 7:
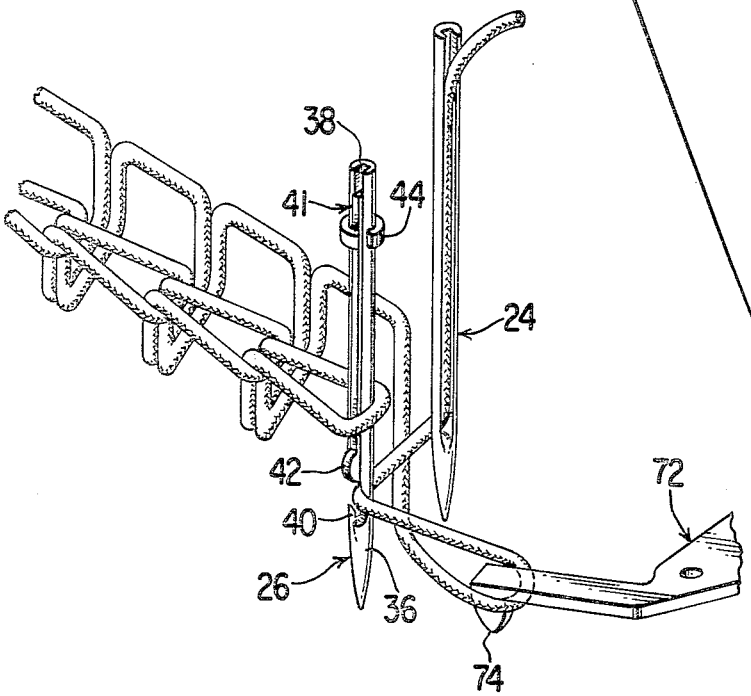
FIG. 7 is a perspective view of the thread concatenation which forms the blind stitch showing how the thread deflecting member insures that thread is drawn into position for capture by the hook needle.

Of the pair of needles carried in the needle bar 16, the needle 24 is a thread-carrying sewing machine needle of conventional design. The needle 26 is a hook needle whose construction and operation is more particularly described in the aforementioned U.S. Pat. No. 3,986,469 to Ketterer. As is best shown in FIG. 7, the hook needle 26 has a body 36 with a recess 38 longitudinally formed therein. The body 36 has a thread engaging hook 40 formed thereon which may engage a limb of thread wrapped around the needle 26. Slidably constrained within the recess 38 for motion toward and away from the hook 40 is a latch member 41 having a hook shield 42 protruding beyond the recess 38 at the lower extremity of the latch member 40. A lateral extension 44 of the latch member is preferably wrapped around the body 36 to slidably restrain the latch member 40 within the recess 38. The hook shield 42 protrudes slightly beyond the recess 38 so that it may be influenced by the passage of the needle 26 into and out of a fabric to effect relative movement of the latch member 41 along the recess 38.

Figure 6:
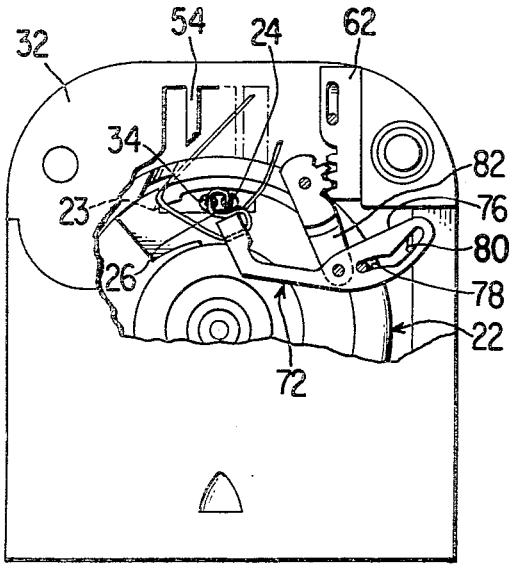
FIG. 6 is a view similar to FIG. 5 showing the position of the thread deflecting member after it has drawn the thread into engagement with the hook needle.
Figure 5:
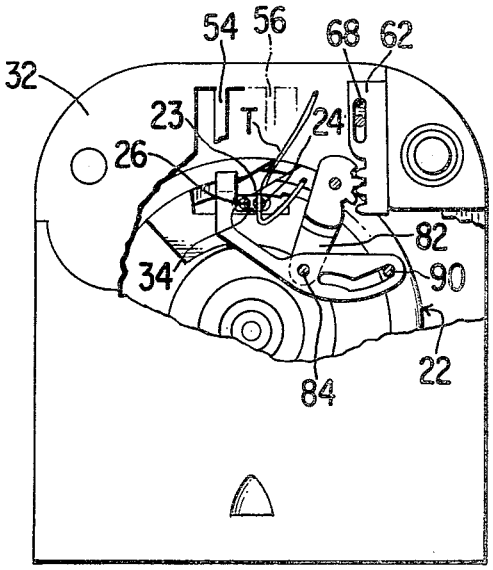
FIG. 5 is a view through the top of the throat plate showing a loop of needle thread as it is seized by the beak of the loop taker and also showing the position of the thread deflecting member before it is driven into engagement with a loop of thread.

FIGS. 5 and 6 show that the thread T from the thread carrying needle 24 is seized during each needle penetration by the beak 23 of the loop taker 22 and is carried laterally by the loop taker across the hook needle 26. The hook needle 26 on its next withdrawal from the fabric carries a loop L of the thread T upwardly through the fabric and through any previously seized loop of thread which may have been held on the hook needle 26. As a result, the single thread chain stitch concatenation shown in FIG. 7 is formed by operation of the sewing machine shown in FIG. 1. Any potential conflict between lock stitch and chain stitch formation is eliminated by removing all thread from the bobbin in the loop taker 22.

FIG. 1 shows that in order to form a blind stitch hem in a garment 44, a plain hem fold 46 is formed inwardly from the face 48 of the garment along the garment edge and the hemfolded garment is placed face down on the bed 10 in which position the hem fold 46 is directed to the stitch forming point and penetrated by the needles 24 and 26. The "face" is that surface which will be exposed to view in the resulting stitched article or gra-ment.

FIG. 8 illustrates the appearance of the single thread chain stitch seam from the face of the garment. The only thread segments which are visible are those which extend between the needles 24 and 26 during the formation of stitches.

The blind stitch seam shown in FIGS. 1, 7 and 8 can be produced using just the needles 24 and 26 and the loop taker 22 as is taught by the aforementioned Ketterer U.S. Pat. No. 3,986,469. Greater certainty of seizure of the thread T by the hook needle 26 may be had, however, by incorporating a thread deflecting member to positively carry a loop of thread into engagement with the hook needle 26.

Figure 4:
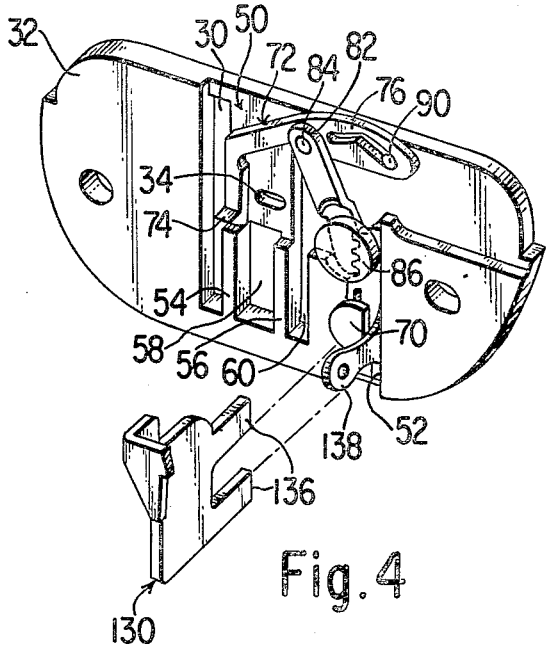
FIG. 4 is a prespective view of the underside of a throat plate showing how the cam-driven bracket engages the drive member carried on the throat plate.

FIG. 4 shows that the underside of the throat plate 32 has a recess 50 formed therein having a straight side 52. A pair of ribs 54 and 56 are formed intermediate a center feed dog accommodating slot 58 and the feed dog slots 30 and 60. The slots 30, 58 and 60 are adapted to accommodate the feed dog 28 so that it may move a garment along a line of material feed in a manner well known in the art of sewing machine construction.

Figure 2:
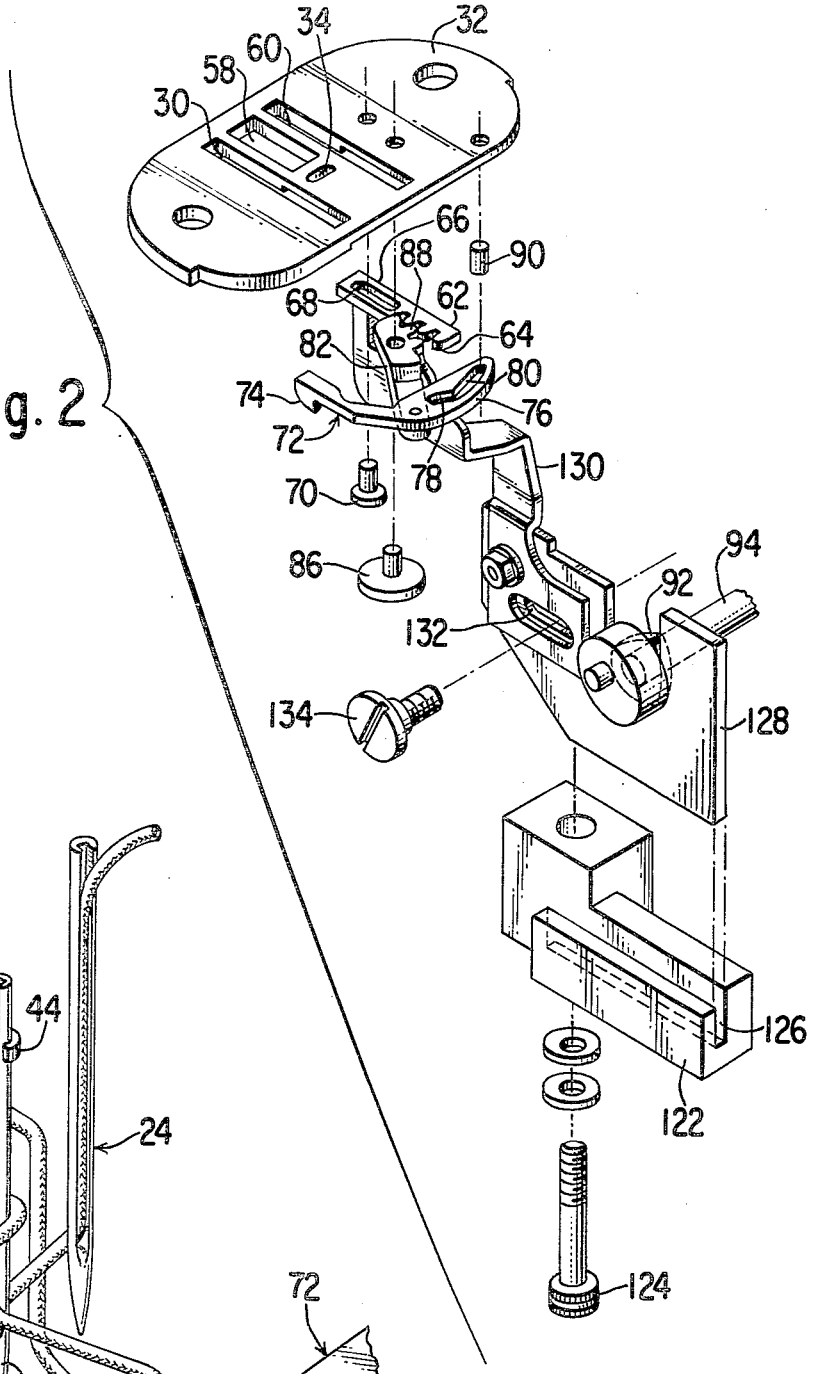
FIG. 2 is a disassembled perspective view of the blind stitch mechanism.

FIG. 2 shows that fastened to the underside of the throat plate 32 within the recess 50 is a drive member which includes a gear rack 62 having a set of teeth 64. The gear rack 62 has a straight surface 66 which is slidably constrained against the straight side 52 of the recess 50. Formed in the body of the gear rack 62 is an elongated slot 68 which receives a restraining pin 70 to slidably restrain the rack 62 against the side 52.

A thread deflecting member, which is shown generally at 72, is formed with a thread engaging finger 74 at one extremity and a body portion 76 in which is cut a slot having an arcuate segment 78 and a connecting straight segment 80. The member 72 is fastened to the underside of the throat plate 32 by fastening a pivotal link 82 to the member 72 with a connecting pin 84, and restraining the link 82 to the throat plate with a pivot pin 86.

FIG. 2 best illustrates that the pivotal link 82 has an arcuate set of radially disposed teeth 88 formed at its extremity opposite that containing the connecting pin 84. Preferably the teeth 88 engage and mesh with the teeth 64 carried on the gear rack 62. The thread deflecting member 72 is constrained in its motion about the surface of the recess 50 by a pin 90 which is fastened to the throat plate 32 and which is received within the slots 78 and 80.

FIGS. 5 and 6 show that due to the shape of the slots 78 and 80, the member 72 may be driven by the gear rack 62 into two positions relative to the elongated needle slot 34.

A preferred means for drivingly connecting the motion of the thread deflecting member 72 to the reciprocation of the needle bar 16, but independent of the length (or stroke) of feed imparted to the fabric by the feed dog 28, include a cam 92 having three faces which is fastened to a feed drive shaft 94 carried in the bed 10. The feed drive shaft 94 may form an element of the drive system which supplies rotary power to drive the feed dog 28 in a manner which is more fully set forth in U.S. Pat. No. 3,527,183 which issued to Szostak et al on Sept. 8, 1970, the teachings of which are incorporated herein by reference.

Figure 9:
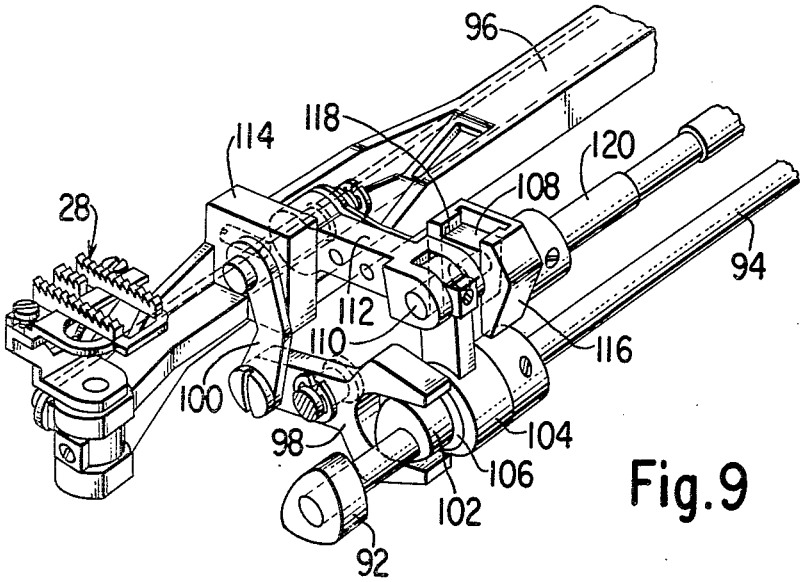
FIG. 9 is a perspective view of a portion of a work feeding mechanism which may be used to drive the thread deflecting member.

FIG. 9 shows a portion of a means for imparting motion to a feed dog which is more fully disclosed in the aforementioned Szostak et al patent. The feed dog 28 is pivotally fastened to one extremity of an elongated feed bar 96 which oscillates the feed dog 28 in an adjustable elliptical path having one component of motion to carry the feed dog 28 above and below the stitch forming area, and a second component for motion toward and away from the elongated needle slot 34. The height of feed dog motion above the stitch forming area is controlled by a bifurcated lever 98 and a link 100 which are oscillated by a cam 102 fastened to the feed drive shaft 94, which rotates in timed synchronization to the rate of reciprocation of the needle bar 16 in a manner which need not be set forth for a full understanding of the present invention.

Figure 10:
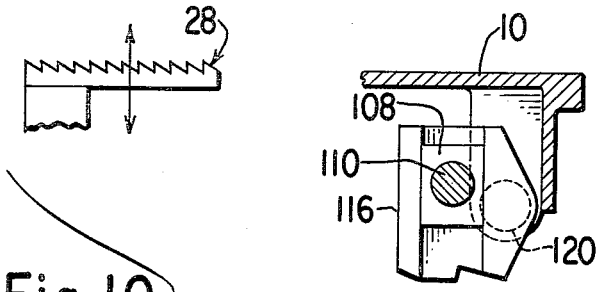
FIG. 10 is an end view of the stitch regulator shown in FIG. 9, showing that no horizontal motion is imparted to the feed dog when the slideway of the stitch regulator is vertically oriented.
Figure 11:
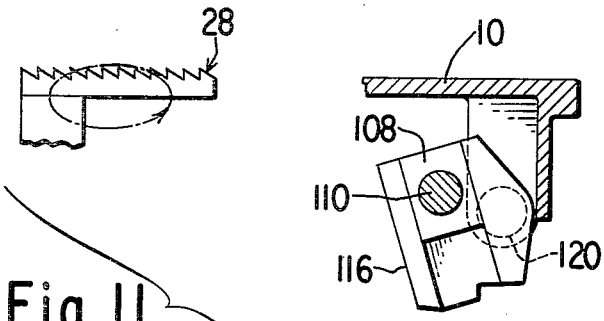
FIG. 11 is a view similar to FIG. 10 showing that the feed dog will partake of a horizontal component of motion as the slideway is tilted away from a vertical direction.
Figure 12:
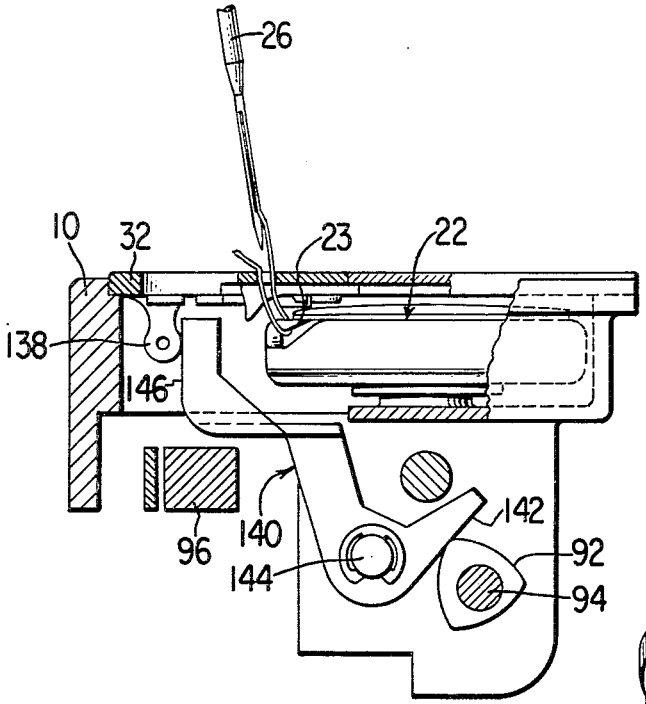
FIG. 12 is a view similar to FIG. 3 showing another embodiment of a cam follower for driving the thread deflecting member.

Fabric feeding toward and away from the needle slot 34 is adjustably controlled by a pitman 104 which embraces a feed advance eccentric 106 fastened to the feed drive shaft 94. The pitman 104 has a slide block 108 pivotally fastened thereto with a pin 110 which also pivotally engages one extremity of a link 112 whose other extremity is pivotally fastened to the feed bar 96 through a block 114. As is more fully described in the aforementioned Szostak et al patent, the length of fabric feeding motion may be adjustably regulated by operator influenced motion varying means which include a block 116 having a slideway 118 in which is received the block 108. The block 116 is rigidly fastened to a feed control rock shaft 120, whose angular displacement may be varied by operator influenced means. FIG. 10 shows that when the block 108 slides vertically up and down within the slideway 118, no horizontal feeding motion is imparted to the feed dog 28. When, however, the feed control rock shaft 120 is adjusted so that the block 116 is tilted as shown in FIG. 11, the block 108 will have imparted thereto a horizontal component of feeding motion which will be transmitted to the feed bar 96 through the link 112. The length of horizontal motion imparted to the feed dog 28 will of course be dependent on the angular displacement from vertical of the block 116, which may be varied by the sewing machine operator to control the stitch length.

The blind stitch mechanism disclosed in the heretofore referenced U.S. Pat. No. 3,908,569 to Ketterer relied on the horizontal component of feed dog motion to impart driving motion to the thread deflecting member 72. It will be apparent from a review of FIGS. 10 and 11 that the horizontal component of motion may be substantially varied by adjusting the angular displacement of the block 116. Motion thereby imparted to the thread deflecting member in the U.S. Pat. No. 3,908,569 may not be of sufficient quantity to insure accurate deflection of the thread around the hook needle 26. If, for example, the feed rock shaft 120 is adjusted to produce a short stitch length by having the slideway 118 assume a nearly vertical position, the horizontal component of motion imparted to the feed dog 28 will be small, and the thread deflecting member will not partake of the full path of motion shown in FIGS. 5 and 6.

The mechanism disclosed herein obviates the unreliable operation of the mechanism disclosed in the U.S. Pat. No. 3,908,569 to Ketterer by supplying a driving motion which is independent of the horizontal component of fabric feeding, but operates in timed synchronization to the reciprocation of the needle bar 16. Since the cam 92 is driven by the feed drive shaft 94, whose speed is independent of the horizontal component of motion imparted to the feed dog, the operation of the thread deflecting member 72 will be independent of the stitch length dictated by the angular position of the block 116, thereby insuring a positive capture of the loop of thread by the hook needle 26.

Figure 3:
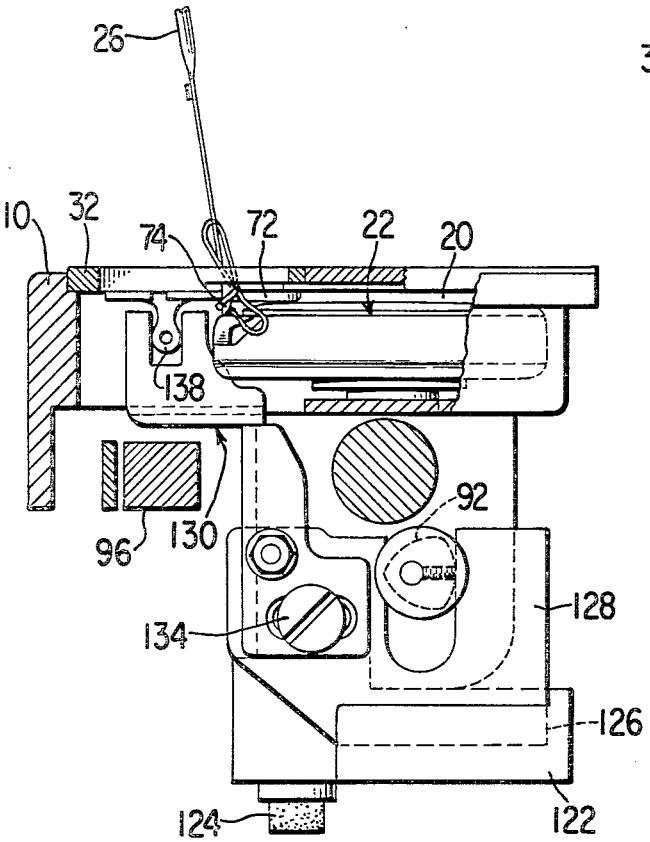
FIG. 3 is a side view of the blind stitch mechanism.

Means for drivingly connecting the thread deflecting member drive mechanism with the feed drive shaft 94 include the cam 92 and a slideway 122 which is fastened to the bed 10 with a screw 124 or other suitable fastener as shown in FIG. 3. The slideway 122 carries a guide slot 126 in which is received a cam follower 128. The follower 128 embraces the cam 92 and is slidably oscillated along the slot 126 by rotation of the cam 92.

A drive mechanism for the thread deflecting member includes the gear rack 62, the pivotal link 82, and a bracket 130 having an adjustment slot 132, which is fastened to the cam follower 128 with a shouldered fastener 134. Preferably the extremity of the bracket 130 opposite that fastened to the follower 128 has a pair of tangs 136 which embrace a downturned member 138 carried by the gear rack 62, so that oscillatory motion imparted to the cam follower 128 by the cam 92 may be transmitted to the gear rack 62 through the bracket 130, while still allowing easy removal of the throat plate 32 from the bed 10 by lifting the downturned member 138 away from engagement with the tangs 136.

FIGS. 5 and 6 show how the thread deflecting member 72 assures that a loop of thread seized by the beak 23 will be captured by the thread engaging hook 40 of the hook needle 26. As the loop taker 22 rotates, the finger 74 is moved out of contact with the rib 54 and into a position where it engages the thread carried by the beak 23. The thread deflecting member 72 is thereafter driven toward the needle 24, with the thread T being drawn against the body of the hook needle 26, as shown in FIG. 6. The thread T will thereafter be in engagement with the hook needle 26 as the needle is drawn upwardly through the needle slot 34, thereby assuring its capture by the thread engaging hook 40, as is shown in FIG. 7, and subsequent withdrawal through the garment.

Figure 13:
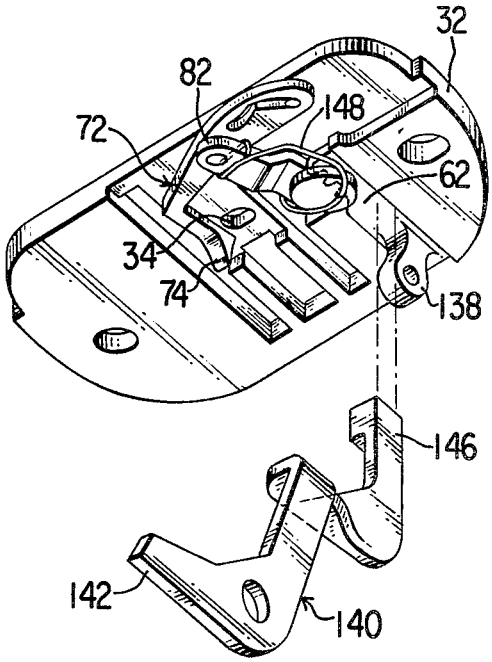
FIG. 13 is a view similar to FIG. 4 showing the spring which cooperates with the cam follower shown in FIG. 9.

FIGS. 9 and 13 show another embodiment of the cam follower which may be used to transmit driving motion from the cam 92 to the thread deflecting member 72. A cam follower 140 has a face 142 at one extremity thereof which engages the cam 92. The follower 140 is pivotally fastened to the bed 10 with a fastener 144. A second extremity 146 of the follower 140 engages the downturned member 138 to produce periodic jogging of the gear rack 62 in response to rotation of the cam 62. A spring member 148 is fastened to the pivotal link 82 to impart a return force to the thread deflecting member 72 in opposition to the force supplied by the cam follower 140. Rotation of the cam 92 produces jogging of the follower 114 which causes the member 72 to be periodically driven into engagement with a loop of thread carried by the loop taker 22, in timed relation to the reciprocation of the needle bar 16. The spring member 148 returns the member 72 to its initial position, where it is available to be driven into engagement with the loop of thread on the next reciprocation of the needle bar 16.

When it is no longer desired to produce a blind stitch, the blind stitch throat plate may be conveniently removed and replaced with a throat plate of conventional design. The cam follower 140 is constructed so that its mass at the extremity supplying motion to the member 138 exceeds the mass of the extremity which engages the cam 92. The face 142 is thereby pivotally removed from engagement with the cam 92, and is therefore precluded from producing any distracting noise as a result of interengagement between the cam 92 and the follower 140. It will be apparent that when it is desired to produce a blind stitch, the blind stitch throat plate may be conveniently installed and the cam follower 140 will thereafter communicate between the cam 92 and the downturned member 138.

What has been described herein is a novel improved blind stitch mechanism which may be easily applied to household sewing machines to permit the sewing of blind stitches without interfering with the machine's capability to produce lock stitches. It will be appreciated that modifications and variations of the above described invention may become evident to one skilled in the sewing machine art in light of the above teachings. However, it is to be understood that the present disclosure relates to but one preferred embodiment which is for the purpose of illustration only, and should not be construed as a limitation on the scope of the invention. All modifications which do not depart from the spirit of the invention are intended to be included within the scope of the appended claims.

We claim:

1. In a sewing machine having a bed including a portion of said bed defining a stitch forming area, a cavity formed in said bed, a loop taker including a loop seizing beak rotatably journalled on a vertical axis in said bed, a needle bar reciprocatorily driven toward and away from said stitch forming area in timed relation to the rotation of said loop taker, said needle bar having fastened thereto a thread carrying needle, a feed dog having at least one component of motion adjustable by operator influenced motion varying means for moving fabric toward and away from said stitch forming area in timed relation to the reciprocation of said needle bar, a removable blind stitch throat plate having at least one aperture for accommodating said feed dog located at said stitch forming area of said bed and a needle slot for accommodating said needle, a feed drive shaft rotatably driven in timed relation to the reciprocation of said needle bar, feed dog motion imparting means driven by said feed drive shaft for imparting fabric feeding motion to said feed dog, a blind stitch mechanism characterized by: a hook needle carried parallel to said throat carrying needle by said needle bar, said hook needle having a body with a longitudinal recess and a thread engaging hook, a latch member slidably constrained within said recess for motion toward and away from said thread engaging hook, a thread deflecting member having a thread engaging finger, said thread deflecting member being pivotally carried beneath said throat plate for engaging a loop of thread seized by the beak of said loop taker from said thread carrying needle and deflecting it around said hook needle, a drive mechanism for said thread deflecting member separate from said feed dog motion imparting means, and independent of said operator influenced feed motion varying means, and means drivingly connecting said thread deflecting member drive mechanism with said feed drive shaft for driving said thread deflecting member into engagement with said loop of thread carried by said loop taker and around the body of said hook needle in timed relation to the reciprocation of said needle bar.

2. The arrangement as set forth in claim 1 wherein said drive mechanism for said thread deflecting member comprises a link having a sector gear pivotally fastened to said thread deflecting member, a gear rack slidably fastened to said throat plate in driving engagement with said sector gear on said link, said gear rack having a downturned drive member fastened thereto, and a bracket engaging said downturned drive member to communicate to said drive member motion toward and away from said needle slot.

3. The arrangement as set forth in claim 2 wherein said means drivingly connecting said thread deflecting member drive mechanism with said feed drive shaft comprises a cam fastened to said feed drive shaft, a block having a slideway fastened to said sewing machine bed, a cam follower carried in said slideway and embracing said cam, said follower being reciprocatorily driven back and forth in said slideway by the rotation of said cam, said follower being fastened to said bracket engaging said downturned drive member to drive said drive member toward and away from said needle slot.

4. The arrangement as set forth in claim 2 wherein said bracket engaging said downturned drive member has a pair of upstanding tangs to freely receive said downturned drive member therebetween.

5. The arrangement as set forth in claim 2 wherein said bracket engaging said downturned drive member is pivotally fastened to said bed, said bracket having a first extremity engaging said cam and a second extremity engaging said downturned drive member, said bracket driving said thread deflecting member into engagement with said loop of thread carried by said loop taker in timed relation to the reciprocation of said needle bar and carrying said loop of thread into engagement with the body of said hook needle, and a spring member fastened to said link of said thread deflecting member drive mechanism for influencing the return of said thread deflecting member after it moves the loop of thread into engagement with said hook needle.

6. The arrangement as set forth in claim 5 wherein said second extremity of said bracket has a greater weight than said first extremity, thereby permitting said first extremity to pivot away from contact with said cam upon removal of said blind stitch throat plate.

* * * * *